US006156387A

United States Patent [19]

Werres et al.

[11] Patent Number: 6,156,387

[45] Date of Patent: Dec. 5, 2000

[54] PROCESS FOR SURFACE TREATMENT OF MATERIAL WEBS, IN PARTICULAR PAPER AND CARDBOARD WEBS, USING ADHESIVE AGENTS

[75] Inventors: Joachim Werres, Drebber; Bernd Reinhardt, Osnabrück, both of Germany

[73] Assignees: Stockhausen GmbH & Co. KG, Krefeld; Kaemmerer GmbH, Osnabrueck, both of Germany

[21] Appl. No.: 09/147,187

[22] PCT Filed: Apr. 18, 1997

[86] PCT No.: PCT/EP97/01953

§ 371 Date: Nov. 5, 1998

§ 102(e) Date: Nov. 5, 1998

[87] PCT Pub. No.: WO97/41300

PCT Pub. Date: Nov. 6, 1997

[30] Foreign Application Priority Data

Apr. 26, 1996 [DE] Germany ..... 196 16 733

[51] Int. Cl.[7] ..... B05D 3/12

[52] U.S. Cl. ..... 427/361; 427/359; 427/363; 427/365; 162/199; 162/179; 162/20.6; 162/164.7

[58] Field of Search ..... 427/359, 361, 427/363, 365; 162/199, 158, 179, 206, 164.7

[56] References Cited

U.S. PATENT DOCUMENTS

| | | | |
|---|---|---|---|
| 3,252,907 | 5/1966 | Kharouf et al. | 252/49.5 |
| 3,505,844 | 4/1970 | McLean | 252/49.5 |
| 4,110,155 | 8/1978 | Minagawa et al. | 162/135 |
| 4,776,970 | 10/1988 | Hayashi et al. | 252/49.5 |
| 5,863,385 | 1/1999 | Siebott et al. | 162/199 |

FOREIGN PATENT DOCUMENTS

| | | | |
|---|---|---|---|
| 0 648 820 | 4/1995 | European Pat. Off. . | |
| 195 19 268 | 1/1997 | Germany | D21H 21/02 |

*Primary Examiner*—Shrive Beck
*Assistant Examiner*—Jennifer Kolb
*Attorney, Agent, or Firm*—Oblon, Spivak, McClelland, Maier & Neustadt, P.C.

[57] ABSTRACT

The invention relates to a process for the thermomechanical surface treatment of flat webs of material, particularly those made of paper and carton, and to agents for performing said process. According to the process of the invention, adhesion between the flat web of material and the surface of the tool used in thermomechanical surface treatment, e.g., a roll or a press, is reduced or prevented by using an abhesive agent, which contains dicarboxylic dialkyl esters and/or diisoalkyl esters of $C_2$–$C_{12}$ dicarboxylic acids with $C_1$–$C_{13}$ n- and/or iso-alkanols as component with abhesive effect. The abhesive agent is preferably employed as an oil-in-water emulsion and is either applied to the surface of the tool used in said thermomechanical treatment or is added to the impregnating fluid or the paper coating mass or the moistening water or the steam in pre-moistening, or is applied to the paper web after the impregnating unit or directly before the smoothing roll. A steam-volatile abhesive agent is preferably used which then is metered through the steam line for steam moistening.

13 Claims, No Drawings

PROCESS FOR SURFACE TREATMENT OF MATERIAL WEBS, IN PARTICULAR PAPER AND CARDBOARD WEBS, USING ADHESIVE AGENTS

The invention relates to the improvement in thermomechanical surface treatment of flat webs of material, particularly paper and carton webs, by using agents which reduce or even prevent adhesion between the flat web of material and the surface of the tool, e.g., a roll, used in said thermomechanical surface treatment (so-called abhesive agents).

In the production process of special grades of paper and carton, the processes for thermomechanical surface treatment represent the final processing stage wherein the properties of the material web can be modified substantially and adjusted to the requirements of use. The catalog of requirements to be met by the types of paper and carton is diverse, including properties such as permeability, ink absorption, printability and/or special barrier properties, e.g., against solvent-containing or aqueous coatings, which in turn are influenced by paper properties such as micro- and macroroughness, porosity, absorbency, picking and abrasion resistance, and absence of dust. Many of these characteristic properties affecting the surface are in close relationship to the local distribution of moisture and raw density.

All of the processes for thermomechanical surface forming of flat webs of material, particularly paper and carton, are based on the functional principle of simultaneous or directly successive action of heat and pressure on the flat material to be formed as the web passes between two or more rolls different in surface characteristics, hardness and flexibility. Frequently, such thermomechanical surface treatment is preceded by a wet pretreatment of the web to be formed, where the pre-moistening may be effected using water or steam. To this end, smoothers, glazing calenders, hot calenders, smoothing rolls, soft calenders and similar devices are used depending on the type of paper or carton grade, the required surface finish and production rate.

However, the well-known processes for thermomechanical surface treatment involve substantial drawbacks arising due to the fact that components of the material to be treated reach their melting and/or softening temperatures when the material is heated to elevated temperature. This results in partial or complete sticking of the material webs to the surface of the above-mentioned equipment, e.g., rolls, by adhesion so that it is not possible to utilize the attainable equipment conditions, e.g., with respect to heat supply and production rate, for an efficient flow of production.

In particular, these drawbacks arise in the production of coated papers having a high percentage of latex in the pigment coating, with surface-sized or coated papers containing water- and/or heat-sensitive binders, and with latex-reinforced, latex-impregnated or latex-coated special papers containing synthetic fibers, where disturbances in the course of production of the type indicated above occur at a specific temperature and/or flow rate.

The use of agents for reducing the adhesive forces between adjacent surfaces (so-called abhesive agents) is well-known. For this purpose, silicones, oil-in-water emulsions, metal soaps, waxes and particularly paraffins and talc are employed. In addition to these materials, film-forming tetrafluoroethylene polymers are employed as antiblocking agents in the processing of thermoplastics. The use of release emulsions based on oil-in-water emulsions made of self-emulsifying fatty acid mono- and triglycerides is familiar in the food industry.

According to EP 0 478 177 A1, and in accordance with this situation, anionic co-emulsions of carnauba wax and paraffin wax are used as antiblocking agents in carton production.

The abhesive agents mentioned so far are not suited for the thermomechanical surface treatment because they either have insufficient effectiveness or cannot be used in accordance with the process, e.g., without affecting the desired surface quality of the products.

The patent specification DE 43 01 677 C2 suggests the use of specific ethylene/acrylic ester copolymerizates in order to improve the printability of plastic films for the furniture industry in the production of thermoplastic laminating films using calenders.

DE 44 12 624 A1 describes paper production with glazing in an offline calender, wherein the material web rolled up on roll is stored intermediately in an ambient atmosphere having controlled temperature and/or humidity in order to obtain uniform treatment and improvement of printability.

Furthermore, compositions are known from EP 0 648 820 A2, which are used for removing toner from paper surfaces, adhesive residues from plastics, stripping plastic coatings and cleaning metal surfaces of cutting oil residues or color pencil marks, and for removing PVC parts attached with adhesives. For this purpose, concentrated oil-in-water emulsions having a non-aqueous phase percentage of 8–90 wt.-% are employed, which contain most various organic compounds, such as dicarboxylic diesters, and are used partly with application of ultrasonics and other means (unwoven fabric strips) within a temperature range of 5–70° C., i.e., partly with additional heating of the cleaning agent during the cleaning procedure. Furthermore, the emulsions contain solvents such as isopropanol, toluene, benzyl alcohol, methyl ethyl ketone, N-methylpyrrolidone, di- and triethylene glycol dimethyl ether, as well as 3-methyl-3-methoxybutanol which restrict the use of these emulsions in closed systems for reasons of industrial safety and due to the hazard to health.

The German patent application P 195 19 268 relates to the use of compositions which are employed as emulsions for cleaning components of machines and plants used in the production of cellulose, paper, cardboard and carton and for preventing staining by adhesives and adhering resins on such machinery and contain saturated or unsaturated fatty acid monoalkyl esters and mono- or polyesters of a saturated or unsaturated uni- or polyvalent carboxylic acid having 2–30 carbon atoms with polyols as component of the oil phase.

EP 0 529 385 B1 describes a process for obtaining smoothness and/or gloss on paper surfaces, wherein the paper web after heating and pressurizing is subjected to a shock treatment in order to obtain surface gloss and smoothness by fixing the preformed fibers.

Furthermore, from the publication by F. Debuan und P. H änβle in Erdöl & Kohle, Erdgas, Petrochemie 37, Vol. 11, pp. 511–514 (1984), it is known to use aliphatic dicarboxylic esters as component for synthetic lubricating oils because of their high-temperature viscosity, low vaporization tendency and resistance to oxidation, wherein it has been found that dicarboxylic esters are deposited on the metal surfaces in combustion motors, and improved piston cleanliness is achieved.

U.S. Pat. No. 4,776,970 describes lubricants with release effect for use in paper coating, especially in paper printing, which are fatty acid esters of $C_{11}$–$C_{21}$ fatty acids with $C_{12}$–$C_{22}$ alkanols and are employed as additive in coating and calendering within a temperature range of 40–100° C. Ethylene glycol distearate tested for the purpose of comparison shows inferior effectiveness as compared to the fatty acid esters described.

Likewise, according to Römpp, 9th edition, p. 5019 (1992), it is known to use specific dicarboxylic esters, particularly those of adipic acid, phthalic acid, sebacic acid and azelaic acid, in the production of plastic products and films.

Therefore, it is the object of the invention to reduce or prevent adhesive effects, especially sticking of material webs to device components of equipment such as rolls and press tools in the thermomechanical surface treatment of flat materials, particularly paper and carton webs, so as to permit the production of such material webs with improved surface quality and at the same time, to be capable of utilizing the available process-technical potential in the production of such flat materials to a higher extent, i.e., to operate at higher flow rates and higher temperatures, for example.

Said object is attained by using agents containing dicarboxylic dialkyl esters and/or esters of saturates and/or unsaturated $C_8$–$C_{18}$ fatty acids with polyvalent alkanols having from 3 to 6 carbon atoms and/or mono- and/or polyunsaturated $C_{16}$–$C_{22}$ fatty acids as abhesively effective components.

Accordingly, the invention is directed to a process for the thermomechanical surface treatment of flat materials, preferably flat materials having a water content of below 50 wt.-%, particularly those made of paper and carton, using at least one abhesive agent, characterized in that the abhesive agent contains dicarboxylic dialkyl esters and/or esters of saturated and/or unsaturated $C_8$–$C_{18}$ fatty acids with polyvalent alkanols having from 3 to 6 carbon atoms and/or mono- and/or polyunsaturated $C_{16}$–$C_{22}$ fatty acids.

It was found that the dicarboxylic esters, esters of saturated and/or unsaturated $C_8$–$C_{18}$ fatty acids with polyvalent alkanols having from 3 to 6 carbon atoms and unsaturated $C_{16}$–$C_{22}$ fatty acids have a surprising abhesive effect on the thermomechanical working procedure, so that sticking of materials to parts of the device, such as heated surfaces of rolls or presses is reduced or completely prevented.

Particularly, in the production of paper and carton webs and, more specifically, in the production of surface-treated special papers, as well as in coating, smoothing or glazing, the agents can be used according to the invention.

Abhesive agents which may be used according to the invention are dicarboxylic esters, preferably dicarboxylic dialkyl and/or diisoalkyl esters of $C_2$–$C_{12}$ dicarboxylic acids with $C_1$–$C_{13}$ n- and/or isoalkanols, such as di-n-butyl oxalate, di-n-butyl malonate, di-n-butyl succinate, di-n-butyl glutarate, di-n-butyl adipate, di-n-butyl suberate, di-n-butyl sebacate, dimethyl adipate, diethyl adipate, di-n-propyl adipate, diisopropyl adipate, diisobutyl adipate, di-tert-butyl adipate, diisoamyl adipate, Di-n-hexyl adipate, di(2-ethylbutyl) adipate, di (2-ethylhexyl) adipate, diisodecyl adipate, dimethyl phthalate, diethyl phthalate, di-n-butyl phthalate, diisobutyl phthalate, di(2-ethylhexyl) phthalate, and diisodecyl phthalate as well as diesters of the $C_9$ dicarboxylic acid (trimethyladipic acid) and dodecanedicarboxylic acid.

Furthermore, esters of saturated and/or unsaturated $C_8$–$C_{18}$ fatty acids with polyvalent alkanols having from 3 to 6 carbon atoms, such as glycerol, sorbitol and sorbitan esters of the above-mentioned fatty acids, e.g., glycerol mono- and/or glycerol di- and/or glycerol trifatty acid esters, sorbitol mono- and difatty acid esters, and sorbitan mono- and/or sorbitan difatty acid esters and/or sorbitan trifatty acid esters may be used.

Preferably, the esters of adipic acid and sorbitan, respectively, are used, and particularly preferred are adipic esters of $C_1$–$C_6$ n- and/or isoalkanols, such as dimethyl adipate, diethyl adipate, di-n-propyl adipate and diisopropyl adipate, di-n-butyl adipate and/or diisobutyl adipate, as well as glycerol trioleate and mixed esters of the above-mentioned dicarboxylic acids and various $C_1$–$C_6$ n- and/or isoalkanols.

Fatty acids which may be used as abhesive agents in accordance with the invention are unsaturated $C_{16}$–$C_{22}$ carboxylic acids, preferably oleic acid, linoleic acid, linolenic acid, eleostearic acid and 5,9,12-octadecanetrienoic acid, which occur as mixtures in plant and animal oils and are known as tall oil fatty acids, for example.

The esters and unsaturated fatty acids are used directly or as a diluted or concentrated aqueous or anhydrous solution or in the form of aqueous dispersions. Suitable solvents are n- and isoalkanols, liquid hydrocarbons, acetone and other well-known solvents and, in particular, natural oils or modified natural oils such as colza oil methyl ester are used.

The abhesively effective esters and unsaturated fatty acids may be employed alone or in combination with appropriate water-soluble or water-insoluble solvents dispersed to emulsions, with non-ionogenic, ionic and amphoteric, particularly non-ionic and anionic surfactants being used as emulsifiers.

Suitable non-ionic emulsifiers are oxalkyl ethers, for example, preferably oxethylates and/or terminally blocked oxethylates of fatty alcohols and fatty acids and oils, respectively. Suited as anionic emulsifiers are alkyl and/or aryl sulfonates, α-olefinesulfonates, α-sulfofatty acid esters, sulfosuccinic esters and alkyl sulfates and ether sulfates as well as carboxymethylated oxethylates and soaps. The preparation of the preferably stable emulsions to be used in accordance with the invention is well-known. For example, the hydrophobic phase containing the abhesive component is added to the aqueous phase containing the emulsifier and dispersed with stirring or recirculating.

According to the invention, the thermally stable abhesive agents of the invention may be applied directly to the surfaces of the devices, i.e., rolls and presses, for example, but likewise, they may be added to the impregnating fluid or the paper coating mass or the moistening water or steam in pre-moistening, or they may be applied to the finished paper web preferably immediately after the impregnating or coating unit or directly before the smoothing roll.

Preferably, the abhesive agent of the invention is metered, preferably in continuous fashion, to the super-heated steam for steam moistening, the steam-volatile abhesive agent being metered, e.g., dissolved in a water-miscible solvent such as ethanol, isopropanol or acetone.

The amount of abhesive agent used can be controlled by using the amounts applied to the surfaces of the devices, i.e., rolls and presses, for example, depending on the required effect, the desired temperature increase or other processing measures. Usually, from 0.1 to 10.0 g/m$^2$, preferably from 0.1 to 5 g/m$^2$ of abhesive agent is applied to the surface of the device. When metering into the super-heated steam line, from 0.1 to 10.0 kg/hour of abhesive agent, preferably from 0.2 to 4.0 kg/hour of abhesive agent is added to the steam. Each of the indicated amounts relates to the active substance of an abhesive agent composition.

According to the invention, the abhesive agents may also be used as a mixture or as a mixture with well-known abhesive agents.

By employing the agents in accordance with the invention, pigment-coated papers are obtained with significant improvement of surface properties, particularly smoothness, gloss and micro-roughness, while the raw density of the paper web remains unchanged. The paper properties of the papers treated according to the invention, working with a single processing step, almost reach a quality level which to date could only be achieved by double soft calendering.

In the production of furniture prepregs, the gloss after varnishing is markedly improved, without affecting the wettability by aqueous and/or solvent-containing gravure inks. Also, the gravure printability is not changed substantially.

When producing flat webs of material in accordance with the invention, using the abhesive agents in accordance with the invention, additional products with markedly improved properties are obtained. Thus, in the production of double-side latex-impregnated and one-side latex-coated, flexible abrasive raw papers, for example, the abhesive agents may be applied to heated steel rolls, thereby permitting an increase in surface temperature by values of more than 70° C., with no adhesive effects occurring. Due to this increase in temperature, an increase in smoothness of about 80%, a reduction in micro-roughness and a decrease in thickness, as well as a decrease in stiffness is achieved.

Similar advantages are obtained in the production of surface-pigmented silicone raw papers when using the agents in accordance with the invention.

The invention will be demonstrated with reference to the following examples, wherein each of the substance-related percentages relates to the weight of the component.

EXAMPLE 1

Stripes about 20 cm in width and about 80 cm in length of a double-side latex-impregnated and subsequently one-side latex-coated abrasive raw paper having 120 g/m$^2$ and an overall latex percentage of about 25% were smoothed at an equilibrium moisture of about 6% in a two-roll laboratory calender from the company Kleinewefers AG, D-47803 Krefeld, at the highest possible line pressure and increasing temperature of the heated steel roll. The counter-roll was a cotton/hard paper roll analogous to a common Hartnip calender construction.

At a steel roll surface temperature of about 60° C., slight adhering of the paper web to the roll already occurred, which was observed to have increased at about 70° C.

When applying the thermostable abhesive agent of the invention, consisting of 1.85 parts by weight of a non-ionogenic plant oil ethoxylate, 17.1 parts by weight of water and 3.1 parts by weight of di-n-butyl adipate, to the heating roll (steel) and further heating the heating roll, massive sticking of the paper web to the steel roll occurred only at a surface temperature of 150° C. Consequently, when comparing the non-treated and treated heating roll, the effect of adhering appeared only after a raise in temperature of more than 70° C. when the abhesive agent was used. Such operation made possible in this way, with stronger heating of the material web, resulted in an increase in smoothness from about 755 Bekk-s to about 1180 Bekk-s, a reduction in micro-roughness (Parker Print Surf) from about 2.8 $\mu$m to about 2.4 $\mu$m, a decrease in thickness from 124 mm to 118 mm, and a reduction in stiffness from 227 mN to 212 mN.

EXAMPLE 2

The abrasive raw paper of 120 g/m$^2$ according to Example 1, impregnated and coated with latex, was moistened to about 13%, stored intermediately in a closed plastic bag for about 1 hour to obtain uniform distribution of moisture within the paper, and glazed thereafter. Again, massive sticking of the paper web began at a surface temperature of the untreated steel roll of above 60° C., while sticking of the paper web to the steel roll treated with the thermostable abhesive agent of Example 1 occurred only at a surface temperature of about 140° C. Considering the higher moisture content of the paper webs prior to glazing (13% instead of 6% in Example 1), the improvements in surface properties of the treated abrasive raw paper were even more significant than those described in Example 1.

EXAMPLE 3

In a pilot plant smoother, the abrasive raw paper of 120 g/m$^2$ according to Examples 1 and 2, impregnated and coated with latex, was subjected to calendering at the maximum possible line pressure and the lowest possible web speed of 5 m/min and with increasing heating at temperatures up to the possible maximum of 200° C. at the surface of the steel roll. The counter-roll had a fiber/plastic coating of 91° Sh D hardness analogous to a soft calender construction.

Calendering was effected at a moisture content of the paper samples of 7.7 and 9.7%, respectively. When the surface of the heating roll was not treated according to the invention, slight sticking already occurred at a surface temperature of 70° C., and massive sticking with the paper sample having higher moisture content. None of the two pre-moistened papers allowed adjusting surface temperatures of more than 80° C. because the sticking effect resulted in wrinkle formation in the paper web.

After treating the surface of the heating roll with the thermostable abhesive agent according to Example 1, no sticking of the paper webs could be detected visually at the maximum possible surface temperature. Due to the increase in temperature from 80 to 200° C., an increase in smoothness of about 80% and a reduction in micro-roughness (Parker Print Surf) by about 25% was achieved in the abrasive raw paper. The decrease in thickness and stiffness was within the value range of Example 1.

EXAMPLE 4

Stripes about 20 cm in width and about 80 cm in length of a veneer strip of 70 g/m$^2$, pre-impregnated with a mixture of latex and urea/formaldehyde resin and having a latex/resin percentage of about 30%, was smoothed on a two-roll calender according to Example 1 after heating the steel roll to the maximum possible surface temperature of 150° C. Beforehand, the paper had been brought to different moisture contents of 2.5%, 6.4%, 7.1%, and 9.4% and subjected to intermediate storage for 1 hour, each one separately in a sealed plastic bag.

In calendering, half of the surface of the heating roll was treated with a thermostable abhesive agent consisting of 4.2 parts by weight of di(2-ethylbutyl) adipate, 23.2 parts by weight of water, and 2.5 parts by weight of a non-ionogenic surfactant.

In calendering, the paper specimen showed substantial sticking to the non-treated roll surface already at web moistures from 7.1% on, while no sticking of the paper webs could be detected on the surface-treated part of the roll even at the highest web moisture of 9.4%.

EXAMPLE 5

Analogous to Example 4, the tests were repeated using a pre-impregnated veneer strip having 80 g/m$^2$ but with a very high content of filler and again, the individual samples were adjusted to different moisture contents of 2.5%, 5.8%, 6.4%, and 8.5%. In calendering, the sample having 5.8% of moisture already showed sticking effects on the non-treated steel roll with a surface temperature of 150° C., which grew stronger and stronger with samples having higher web moisture. On a surface treated with a thermostable abhesive agent consisting of 4.2 parts by weight of diisodecyl adipate, 23.2 parts by weight of water and 2.5 parts by weight of a non-ionogenic surfactant, slight sticking was detected only at a web moisture of 8.5%.

EXAMPLE 6

Analogous to the conditions of Example 4, the tests were repeated using a one-side surface-pigmented silicone raw paper having 62 g/m$^2$. The applied coating was 5 g/m$_2$, with a very high latex ratio of more than 40%. The samples were pre-moistened to 4.5%, 8.1%, 9.2%, and 12.0%, respectively, and again, each one was stored separately. After heating the steel roll to the maximum possible surface temperature of 150° C., slight sticking occurred on the non-treated part of the roll at 12%. On a steel roll treated with a thermostable abhesive agent consisting of 5.46 parts by weight of trimethyladipic acid $C_{8/10}$ alfol ester, 25.0 parts by weight of water, 5.2 parts of isopropanol, and 3.3 parts by weight of a non-ionogenic surfactant, no sticking of paper was detected even at the highest web moisture.

EXAMPLES 7–12

In a heated laboratory calender according to Example 1, abrasive paper having an applied finish was glazed at a line pressure of 400 bars, and the surface of the steel cylinder was adjusted to temperatures of 70° C. and 130° C., respectively. Various abhesive agents were tested in the form of an oil-in-water emulsion, where the abhesive agent was applied to the surface by rubbing the heated steel cylinder. The emulsions were prepared using 2.0 parts by weight of a fatty alcohol oxethylate, 11.6 parts by weight of water and 1.3 parts by weight of the abhesive component. In calendering, the sticking behavior and the flatness of the glazed paper were assessed using the features: slight rolling (+), nearly plane flatness (++) and ideal flatness (+++). When sticking (+) to the roll surface, the paper was twisted into a crepe paper-like condition.

The results are summarized in the following Table 1:

TABLE 1

| Example | Abhesive component | Sticking behavior at 70° C. | Sticking behavior at 130° C. | Flatness at 70° C. | Flatness at 130° C. |
|---|---|---|---|---|---|
| 7 | Tall oil fatty acid | | | ++ | + |
| 8 | Sorbitan monostearate | | | +++ | + |
| 9 | Glycerol trioleate | | | ++ | ++ |
| 10 | Di-n-butyl phthalate | | | + | + |
| 11 | Diisononyl phthalate | | + | + | |
| 12 | Di-n-butyl adipate | | | +++ | +++ |

EXAMPLE 13

An examination was conducted whether the surface properties of papers with respect to wetting by water, aqueous varnishes or aqueous gravure inks would change when using the thermostable abhesive agent.

To this end, the abhesive agent diluted with water at a ratio of 1:1 and 1:10, respectively, was applied to the furniture prepreg according to Example 4, using a laboratory doctor coating device and subsequently glazed in a two-roll laboratory calender, according to Example 1, at the highest possible line pressure and a surface temperature of the heated steel roll of 150° C.

The smoothing level of the paper samples glazed in the above fashion was 300±30 Bekk-s smoothness. A similarly laboratory-glazed paper specimen having about 300 Bekk-s, but without the surface coating, was used as comparative sample. The data in Table 2 demonstrate that the contact angle to the water in the glazed sample is not signifcantly changed by the abhesive agent, while notable improvement in gloss is achieved after varnishing when using the adhesive agent at a mixing ratio with water of 1:1. The gravure printability is slightly changed relative to the comparative sample.

The experimental data also demonstrate that the paper subjected to a surface treatment using thermostable abhesive agents is not impaired with respect to wettability by water and, in part, is even improved to some extent. In a similar fashion, a significant difference in the wetting behavior of the papers was neither detected when compared to solvent-containing inks. For further comparison, the data of a non-smoothed paper (zero sample) and a paper produced under production conditions are illustrated in Table 2.

TABLE 2

Properties of furniture prepregs, 70 g/m$^2$, after various surface treatments

| Example 13 | Contact angle, Degrees | Gloss (75°) (after SH varnishing, aqueous), % | Printability (laboratory gravure printing, aqueous), Rating*) |
|---|---|---|---|
| Laboratory calender | | | |
| without abhesive agent | 102.9 | 59.2 | 2 |
| with abhesive agent | | | |
| diluted 1:1 | 102.8 | 64.5 | 3 |
| diluted 1:10 | 104.4 | 52.8 | 4 |

TABLE 2-continued

| Properties of furniture prepregs, 70 g/m², after various surface treatments | | | |
|---|---|---|---|
| Example 13 | Contact angle, Degrees | Gloss (75°) (after SH varnishing, aqueous), % | Printability (laboratory gravure printing, aqueous), Rating*) |
| Zero sample (without abhesive agent) | 105.6 | 45.3 | 5 |
| Soft nip calender (without abhesive agent) | 92.4 | 71.4 | 1 |

*)Ratings: 1 very good; 5 worst
The resistance of the samples to adhesive tape was perfect.
As to paintability, no drawbacks due to lacking wettability could be detected.

EXAMPLE 14

A one-side pigment-coated paper having 50 g/m² (raw paper, Test No. 200) was smoothed in a pilot plant smoother (soft calender: steel/plastic roll) under the following practical conditions:

Speed: 500 m/min
Line pressure: 400 kN/m²
Double-side steam moistening prior to first run
Surface temperature of the (lower) heating roll
First run 120° C. and 160° C., respectively
Second run 160° C.

The entirely steam-volatile abhesive agent consisting of a 10% solution of di-n-butyl adipate in isopropanol was introduced continuously into the heating steam line for the lower steam moistener, metering 1 1/hour.

The test was performed through the individual steps Test No. 201 to Test No. 204 wherein, prior to the first run, steam was to be applied to the paper web in such an amount until more and more deposits on the heated calender roll (steel) could be observed.

In Test 201, it was possible to apply 2×58 kg of steam per hour at 120° C., before deposits appeared on the heating roll. By adding the abhesive agent of the invention according to Example 1, the maximum possible amount of steam of about 110 kg of steam per hour could be applied in Test 203, without deposits appearing on the roll. At the same time, however, the final moisture of the paper increased by about 0.5% (absolute), so that a slight decrease in the values of the surface properties occurred. In test 204, using the abhesive agent at an elevated roll temperature of 160° C., it was possible to expose the paper web to the maximum possible amount of steam of 170 kg of steam per hour (total), wherein no deposits could be detected on the smoother roll.

Due to the increase in temperature by 40° C. and the simultaneously increased steam absorption of 54 kg/hour (total), a significant improvement in the surface properties of the paper regarding smoothness, gloss and micro-roughness was achieved, while the raw density remained unchanged.

The paper properties almost reach a quality level which to date could only be achieved by double soft calendering (Test No. 202).

Test data and paper properties after soft calendering with and without use of the abhesive agent are given in Table 3 for comparison.

TABLE 3

| Soft calendering of light-weight paper P, 50 g/m² | | | | | | | | | |
|---|---|---|---|---|---|---|---|---|---|
| | Soft calendar | | VIB Gloss Profiler | | Paper properties | | | | |
| | | Temperature | Amount of steam in kg/hr | | | Raw | Gloss | | |
| Test No. | Nip | °C. | Upper | Lower | Final moisture, % | density, g/cm³ | (75°) % | PPS μm | Smoothness Bekk-s |
| 200 (raw paper) | 0 | — | — | — | 5.0 | 0.80 | 7 | 7.56 | 11 |
| 201 | 1× | 120 | 58 | 58 | 6.7 | 1.02 | 32 | 3.36 | 229 |
| 203*) | 1× | 120 | 58 | 110*) | 7.2 | 1.01 | 28 | 3.53 | 197 |
| 204*) | 1× | 160 | 80 | 90*) | 5.1 | 1.02 | 38 | 3.09 | 288 |
| 202 | 2× | 120/160 | 58 (First run) | 58 | 6.2 | 1.04 | 40 | 2.87 | 347 |

*)With adhesive agent

What is claimed is:

1. A process for the thermomechanical surface treatment of flat materials made of paper and carton, comprising treating the surface of said flat materials directly or indirectly with at least one abhesive agent which contains a dicarboxylic acid diester of a $C_2$–$C_{12}$ dicarboxylic acid and a $C_1$–$C_{13}$ n- and/or isoalkanol.

2. The process according to claim 1, wherein the abhesive agent contains adipic diesters of $C_1$–$C_6$ n- and/or isoalkanols.

3. The process according to claim 1 or 2, wherein the abhesive agent is employed as an oil-in-water emulsion.

4. The process according to claim 1, wherein the abhesive agent is applied to the surface of a tool used in the thermomechanical treatment, or is added to an impregnating fluid or a paper coating mass or a moistening water or steam in pre-moistening, or is applied to a paper web immediately after an impregnating or coating unit or directly before a smoothing roll.

5. The process according to claim 4, wherein the abhesive agent is steam-volatile and is metered in continuous fashion, through a steam line for steam moistening.

6. The process according to claim 5, wherein the abhesive agent is used in amounts of from 0.1 to 10.0 $g/m^2$ of equipment surface, based on the active substance of the abhesive agent.

7. The process according to claim 6, wherein the abhesive agent is added to the steam in amounts of from 0.1 to 10.0 kg/hr, based on active substance.

8. The process according to claim 3, wherein the oil-in-water emulsion of the abhesive agent includes a non-ionic, anionic or amphoteric emulsifier.

9. The process according to claim 1, wherein the flat materials are used with a water content of below 50% by weight.

10. The process according to claim 2, wherein the abhesive agent is applied to the surface of a tool used in the thermomechanical treatment, or is added to an impregnating fluid or a paper coating mass or a moistening water or steam in pre-moistening, or is applied to a paper web immediately after an impregnating or coating unit or directly before a smoothing roll.

11. The process according to claim 3, wherein the adhesive agent is applied to the surface of a tool used in the thermomechanical treatment, or is added to an impregnating fluid or a paper coating mass or a moistening water or steam in pre-moistening, or is applied to a paper web immediately after an impregnating or coating unit or directly before a smoothing roll.

12. The process of claim 7, wherein the abhesive agent is added to the steam in amounts of from 0.2 to 4.0 kg/hr.

13. The process according to claim 8, wherein the oil-in-water emulsion of the abhesive agent includes a non-ionic or anionic emulsifier.

* * * * *